US005875909A

United States Patent [19]

Guglielmini

[11] Patent Number: 5,875,909

[45] Date of Patent: Mar. 2, 1999

[54] SCREW CAP WITH ATTACHED SEAL

[75] Inventor: Bernard Guglielmini, Crimolois, France

[73] Assignee: Rical S.A., Longvic Cedex, France

[21] Appl. No.: 897,536

[22] Filed: Jul. 21, 1997

Related U.S. Application Data

[63] Continuation of Ser. No. 504,366, Jul. 19, 1995, abandoned.

[30] Foreign Application Priority Data

Jul. 20, 1994 [FR] France ..... 94 08993

[51] Int. Cl.[6] ..... B65D 53/00

[52] U.S. Cl. ..... 215/350; 215/351

[58] Field of Search ..... 215/345, 350, 215/351

[56] References Cited

U.S. PATENT DOCUMENTS

| | | | |
|---|---|---|---|
| 4,462,502 | 7/1984 | Luenser et al. | 215/329 |
| 4,629,083 | 12/1986 | Druitt | 215/329 |
| 4,930,646 | 6/1990 | Emslander . | |
| 5,197,621 | 3/1993 | Bartl et al. | 215/331 |
| 5,285,913 | 2/1994 | Morton | 215/349 |
| 5,356,021 | 10/1994 | McBride et al. | 215/349 |

FOREIGN PATENT DOCUMENTS

| | | | |
|---|---|---|---|
| 459783 | 9/1949 | Canada | 215/350 |
| 0263699 | 4/1988 | European Pat. Off. . | |
| 0473529 | 3/1992 | European Pat. Off. . | |
| 0530977 | 3/1993 | European Pat. Off. . | |
| 683521 | 12/1952 | United Kingdom | 215/350 |
| WO82/02182 | 7/1982 | WIPO . | |
| WO94/12399 | 6/1994 | WIPO . | |

*Primary Examiner*—Stephen K. Cronin
*Attorney, Agent, or Firm*—Beveridge, DeGrandi, Weilacher & Young, LLP

[57] ABSTRACT

A bottle cap with a gas barrier seal for use in combination with the screw threaded neck of a carbonated beverage container and the like, having a body formed with an annular skirt and an end wall and a relatively stiff, high gas barrier, circular seal having a diameter greater than the outside diameter of the neck of the container where the seal is inserted adjacent the end wall into the cap body which includes a frusto-conical bead clamping element having a cone angle equal to or less than 90° and an annular rib to prevent lateral displacement of the circular seal.

14 Claims, 2 Drawing Sheets

SCREW CAP WITH ATTACHED SEAL

This application is a continuation of application Ser. No. 08/504,366, filed Jul. 19, 1993, abandoned.

The present invention concerns a cap for the screwthreaded neck of a container such as a bottle, the cap comprising a cap body having an end wall, an annular skirt projecting from the end wall and having an internal screwthread, and a circular seal having an outside diameter greater than the outside diameter of the neck, inserted in the cap body in a position adjacent the end wall, the cap body having means for clamping the seal against the end face and against the outside edge of the neck of the container.

Caps of this type are described in patent application EP-A-0 055 916 and patent U.S. Pat. No. 4,658,976, for example.

In application EP-A-0 055 916, an annular bead is provided on the inside of the cap body, where the end wall and the skirt intersect. Referring to FIG. 3, this bead is in the shape of a rectangular step with a vertical flank substantially aligned with the outside surface of the neck, a horizontal flank and a convex part joining these two flanks together. Referring to FIG. 6, the bead can be a convex bead without horizontal and vertical flanks, merging with the skirt perpendicularly to the axis of the cap body and merging with the end wall at an angle of approximately 45°. Referring to FIG. 7, the bead is a simple concave bead, i.e. a rounded intersection of the end wall and the skirt of the cap body. Note that in all the embodiments a retaining ring is provided on the skirt to hold the seal in position.

In patent U.S. Pat. No. 4,658,976, an annular step also having a vertical flank and a horizontal flank is provided at the intersection of the end wall and the skirt of the cap body. However, in this case the vertical flank of this step is not aligned with the outside face of the neck of the container, but is offset outwards relative to this face by a distance much less than the thickness of the seal so that, when the cap is screwed onto the neck, the outside part of the seal flexes and this part of the seal is clamped against the outside face of the neck, compressed by an amount which reduces the thickness of the seal between 40% and 60%.

These prior art caps have given satisfactory results when used with seals made from a flexible material such as ethylene vinyl acetate (EVA), for example. However, the use of such seals in cap bodies made from plastics materials such as polypropylene has the drawback that the materials used to make the seals and the materials used to make the cap body are relatively permeable to gases such as oxygen, carbon dioxide and nitrogen. Accordingly, the shelf life of products packaged in bottles, flasks or other containers closed by caps of this kind is short because of gaseous exchange via the cap.

This gaseous exchange can lead to penetration of oxygen into the container, for example, leading to deterioration of the organoleptic properties of sensitive products such as unsaturated fats. It can also lead to loss of aroma of aromatic substances. Such gas exchange can also lead to the product in the container absorbing undesirable outside odours associated with the environment in which the product is stored, for example. For this reason, seals have already been proposed for such applications that provide a better barrier to gases and to other volatile substances. Seals of this kind include at least one layer of a plastics material constituting a gas barrier, having a high stiffness and possibly combined with at least one layer of a plastics material having a low stiffness. The high stiffness gas barrier layer may be made from polyethylene teraphthalate (PET), polyamide (PA), polyvinylidine fluoride (PVDC) or ethylene/vinyl alcohol (E/VAL), for example, having a stiffness in the order of 1 300 MPa to 2 200 MPa.

The use of seals of this type in caps as described in the prior art documents mentioned above has proved unsatisfactory, these rigid seals, unlike the flexible seals normally used in these caps, tending not to espouse the shape of the annular clamping bead and therefore not to enclose sufficiently the lateral part of the neck and even to take up a position within the cap body oblique to the neck. In all cases this compromises the seal, which may even be intermittent.

The present invention is directed to a screw cap which provides a good seal even if a high stiffness seal is used. The invention is further directed to a cap combining a good seal with good gas impermeability, through the use of a seal made from a high stiffness gas barrier plastics material or comprising at least one layer of a material of this kind.

The capsule of the invention for the screwthreaded neck of a container comprises a cap body and a circular seal inserted in the cap body. The cap body comprises an end wall and an annular skirt projecting from the end wall and having an internal screwthread. The seal has an outside diameter greater than the outside diameter of the neck of the container to be capped. The cap body has means for clamping the seal against the end face and against the outside edge of the neck. Said means comprise an annular bead on the inside of the cap body where the end wall and the skirt intersect and defining within the cap body, over a height greater than the thickness of the seal, a generally frustoconical shape with a cone angle equal to or less than 90°.

Because of this shape of the bead, even if it is relatively stiff the seal can nevertheless deform to espouse the shape of the bead and therefore be clamped against the outside edge of the neck all the way around to provide a seal at that edge, even if the latter is irregular, this requiring relatively slight compression of the seal.

Said bead preferably extends over a height equal to at least twice the thickness of the seal.

The cone angle of the generally frustoconical shape of the bead can advantageously be between 90° and 45°, preferably about 60°.

In one preferred embodiment of the invention this generally frustoconical shape can be defined by two frustoconical parts of which one has a cone angle between 45° and 60° and merges through a concave part with the end wall of the cap body and the other has a cone angle between 60° and 90° and merges through a concave part with the skirt of the cap body, the two frustoconical parts merging through a convex part.

One embodiment of a cap in accordance with the invention is described in more detail hereinafter by way of non-limiting illustrative example only and with reference to the appended diagrammatic drawings, in which.

Figure 1:
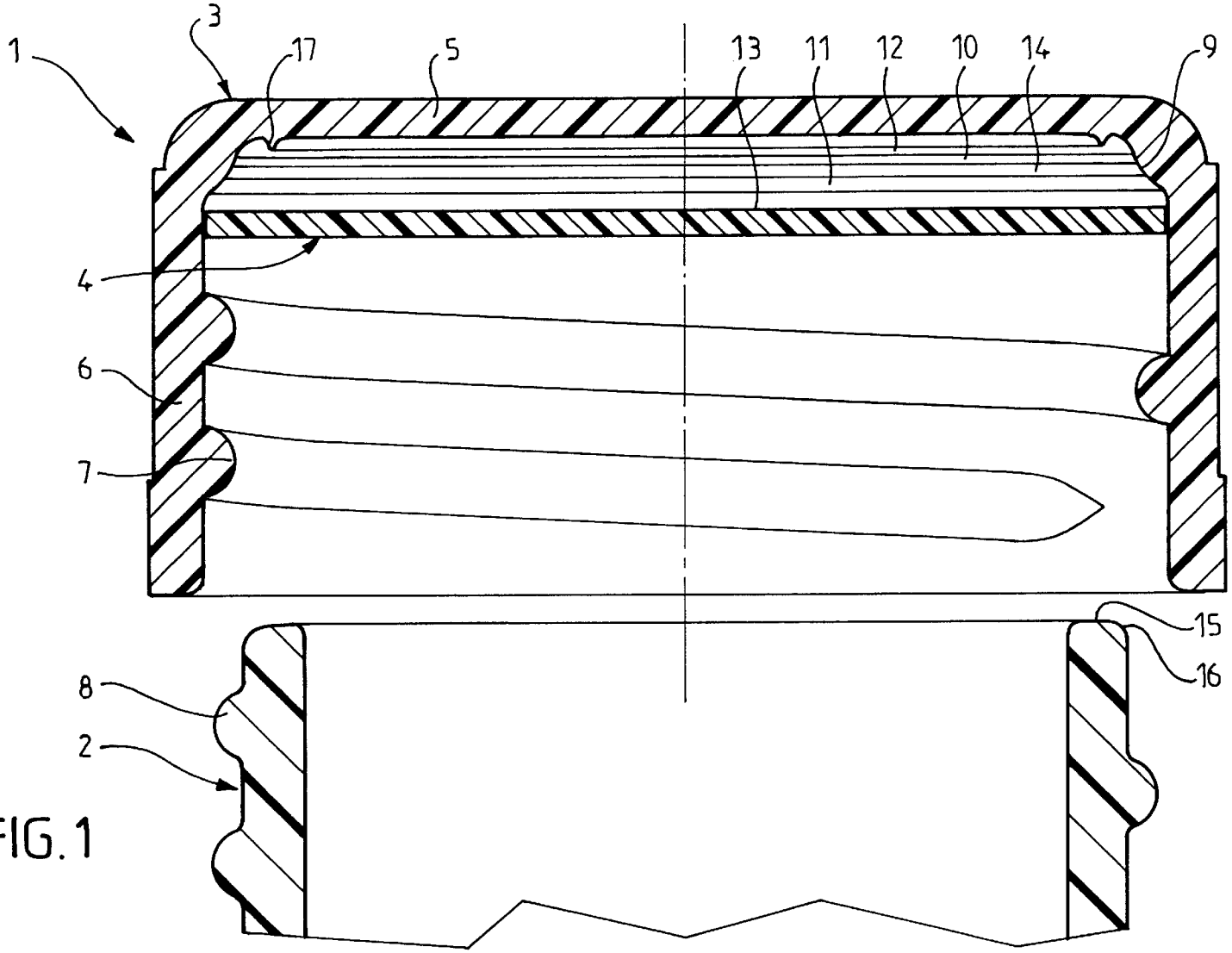
FIG. 1 is a view in axial section of a cap of the invention before clamping the seal.

The screw cap 1 shown in FIG. 1 is designed to cap the neck 2 of a bottle containing a carbonated drink, for example.

The cap 1 comprises a cap body 3 and an attached seal 4.

The cap body 3 has an end wall 5 and an annular skirt 6 projecting from the end wall 5. The wall 6 has a screwthread 7 on the inside adapted to cooperate with an exterior screwthread 8 on the neck 2 when the cap 1 is screwed onto the neck 2.

The cap body 3 has a bead 9 on the inside where the skirt 6 and the end wall 5 intersect.

The internal bead 9 defines a generally frustoconical shape with a cone angle less than 90°, in this example about 60°. This generally frustoconical shape is defined by two frustoconical parts 10 and 11 of which the first has a cone angle of about 45° and the second has a cone angle of about 90°, the part 10 merging with the end wall 5 through a concave part 12 and the part 11 merging with the skirt 6 through a concave part 13. The two parts 10 and 11 merge with each other through a convex part 14.

Note that the height of the bead 9 is greater than the thickness of the seal 4. In the example shown the height of the bead 9 is about four times the thickness of the seal 4.

The seal 4 has an outside diameter substantially equal to the inside diameter of the skirt 6 in the part above the screwthread 7. The seal 4 inserted into the cap body 3, between the screwthread 7 and the end wall 5, is adapted to seal the neck 2 when the cap 1 is screwed onto the latter.

Figure 2:
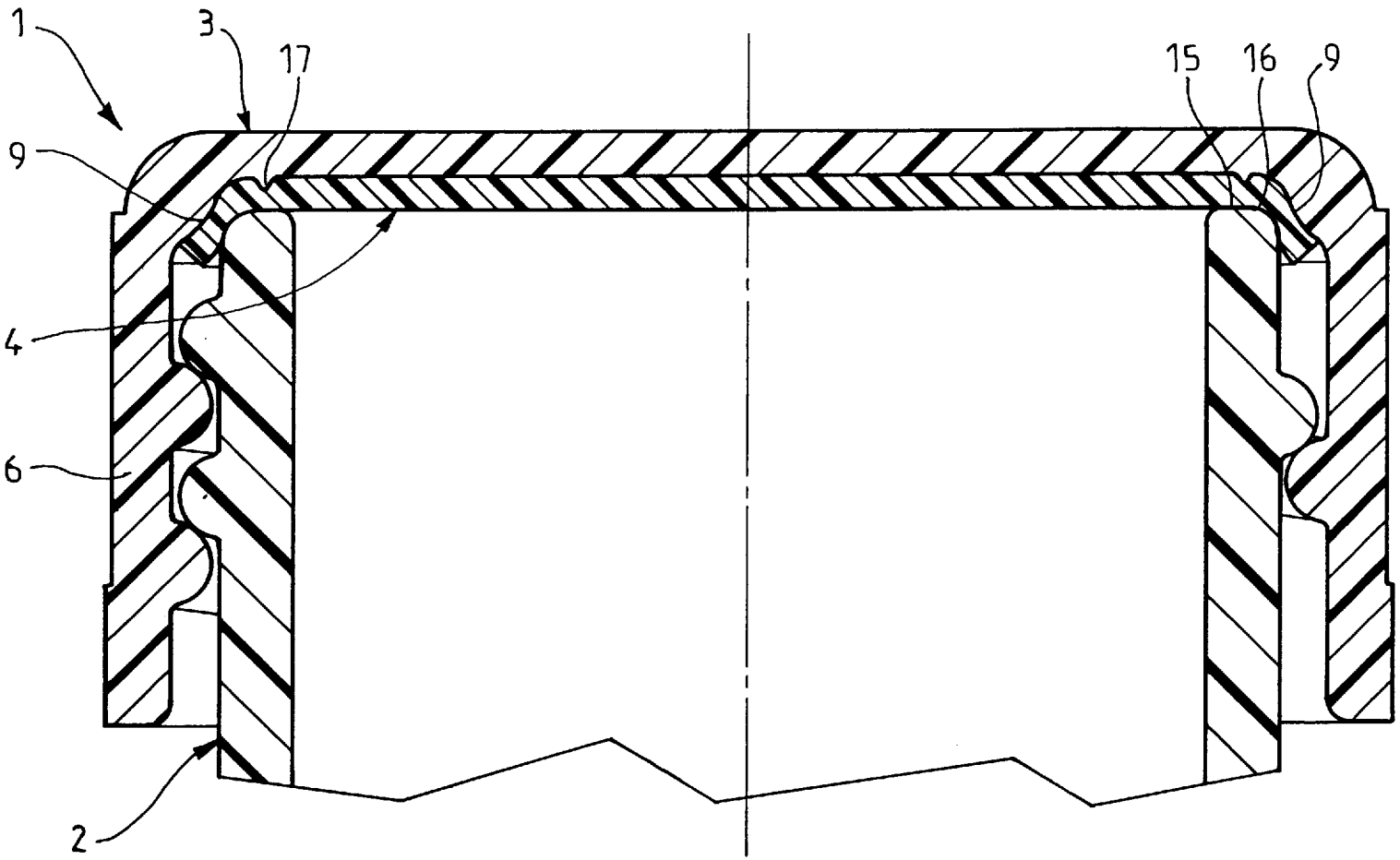
FIG. 2 is a view in section of the cap from FIG. 1 after the seal is clamped by screwing the cap onto a neck.

Referring to FIG. 2, the seal must be produced firstly by clamping the seal 4 against the end face 15 of the neck 2 and the end wall 5 of the cap body 3 and secondly by clamping the seal 4 between the outside edge 16 of the neck 2 and the inside bead 9 of the cap body 3. Even if it is stiff, the seal 4 can espouse the shape of the bead by flexing less than 90°, by about 60° in this example, and is only slightly compressed.

Although the cap as described hereinabove can be used in combination with any type of attached seal 4, including flexible seals made from ethylene vinyl acetate copolymer or polyvinylchloride, for example, it has particular advantages when used in combination with rigid seals, designed specifically for good impermeability to gases. These are, for example, composite seals comprising at least one high stiffness layer possibly combined with one or more low stiffness layers. A composite seal of this kind can comprise, for example, a middle layer of PET, PA, PVDC or E/VAL film between 100 μm and 250 μm thick, having a stiffness between about 1 300 MPa and about 2 200 MPa, and at least two outside layers each comprising an elastomer PP film between 300 μm and 550 μm thick, having a stiffness between about 100 MPa and about 300 MPa. A composite seal of this kind represents an optimal combination of gas impermeability properties, due to the barrier effect of the high stiffness middle layer, and liquid sealing properties, due to the outside low stiffness layers.

A cap combining a polypropylene cap body and a rigid composite seal of this kind is particularly advantageous for capping bottles containing carbonated drink.

Especially when a rigid seal 4 is used, it may be advantageous to provide on the bottom face of the end wall 5 of the cap body 3, preferably above the end face 15 of the neck 2, locating means to prevent any lateral displacement of the seal, for example in the form of a continuous or discontinuous annular rib 17 with various shapes, preferably a V-shape, and with a sharp or rounded top. The height of such locating means can be between about 0.1 mm and about 0.3 mm in the case of a seal of the type described above by way of example. These locating means are impressed into the seal 4 when the cap is screwed down, as can be seen in FIG. 2.

I claim:

1. A closure cap for a container having a threaded neck of a select outside diameter, said cap comprising:

a cap body having an end wall and an annular skirt projecting from said end wall, said annular skirt having provided thereon an internal thread for engaging the threaded container neck when said cap is screwed on said neck;

a seal, said seal being inserted into the cap body in a position adjacent said end wall and having a diameter greater than the select outside diameter of the container neck, said seal including a first layer of a gas barrier plastics material having a stiffness between about 1300 MPa and about 2200 MPa;

a bead formed with a generally frustoconical shape in the region of the intersection of said skirt with said end wall, said bead extending over a height equal to at least twice the thickness of the seal, and having a cone angle of not greater than 90°.

2. Cap according to claim 1 wherein said layer is formed from a PET, PA, PVDC or E/VAL film.

3. Cap according to claim 1 wherein said generally frustoconical shape of said bead is defined by two frustoconical parts, the first frustoconical part having a cone angle between 45° and 60° and the second frustoconical part having a cone angle between 60° and 90°, said two frustoconical parts merging through a convex part.

4. Cap according to claim 1 wherein the cap body has, on the inside face of the end wall, above the end face of the neck, projecting locating means which are positioned so as to impress into the seal when the cap is screwed down onto the neck.

5. The cap according to claim 1, wherein the cone angle of said bead is between 90° and 45°.

6. The cap according to claim 1, wherein the cone angle of said bead is about 60°.

7. A method of sealing a container using the cap according to claim 1.

8. A method of making a sealed container using the cap according to claim 1.

9. Cap according to claim 1 wherein the first layer has a thickness of at least 100 μm.

10. Cap according to claim 9 wherein the first layer is between 100 μm and 250 μm thick.

11. Cap according to claim 1 wherein the seal further includes a second layer between 300 μm and 550 μm thick of a plastics material having a stiffness between about 100 MPa and about 300 MPa.

12. Cap according to claim 11 wherein said second layer is formed from a PP elastomer film.

13. Cap according to claim 11 wherein the seal further includes a third layer between 300 μm and 550 μm thick of a plastics material having a stiffness between about 100 MPa and about 300 MPa, said first layer being sandwiched between said second layer and said third layer.

14. Cap according to claim 13 wherein said third layer is formed from a PP elastomer film.

* * * * *